United States Patent [19]

Yamamoto et al.

[11] Patent Number: 4,602,682

[45] Date of Patent: Jul. 29, 1986

[54] HEAT EXCHANGER

[75] Inventors: Hisashi Yamamoto, Katsuta; Masanori Yamakawa, Hitachi, both of Japan

[73] Assignee: Hitachi, Ltd., Tokyo, Japan

[21] Appl. No.: 475,556

[22] Filed: Mar. 15, 1983

[30] Foreign Application Priority Data

Mar. 15, 1982 [JP] Japan ..... 57-39491

[51] Int. Cl.[4] ..... F28F 9/02

[52] U.S. Cl. ..... 165/174; 122/32; 122/33

[58] Field of Search ..... 122/32, 33; 165/141, 165/174

[56] References Cited

U.S. PATENT DOCUMENTS

| | | | |
|---|---|---|---|
| 2,097,602 | 11/1937 | Rohlin | 237/74 |
| 3,363,679 | 1/1968 | Ernest | 165/141 |
| 3,437,077 | 4/1969 | Ammon et al. | 122/32 |
| 3,776,199 | 12/1973 | Miller | 122/33 |
| 3,776,302 | 12/1973 | Waszink et al. | 122/32 |
| 3,827,484 | 8/1974 | Wolowodink | 165/161 |
| 4,204,502 | 5/1980 | Forestier et al. | 122/32 |
| 4,452,182 | 6/1984 | Baudoin | 122/32 |

FOREIGN PATENT DOCUMENTS

| | | |
|---|---|---|
| 1253859 | 1/1961 | France . |
| 1511662 | 2/1968 | France . |
| 2127983 | 9/1972 | France . |
| 2402176 | 9/1977 | France . |
| 2394051 | 6/1978 | France . |
| 2452687 | 10/1980 | France . |
| 56-42690 | 4/1981 | Japan . |
| 57-136095 | 8/1982 | Japan . |

*Primary Examiner*—Henry C. Yuen

*Attorney, Agent, or Firm*—Beall Law Offices

[57] ABSTRACT

A heat exchanger has upper and lower plenums which communicate with each other via heat transfer tubes. A downwardly-extending tube used to introduce secondary sodium coolant into the lower plenum extends among the heat transfer tubes and is fastened to the lower tube plate to communicate with the lower plenum. The downwardly-extending tube is stretched through the lower plenum in the axial direction thereof to contact at its lower end a bottom surface of the heat exchanger body. A plurality of openings are provided in a wall of the portion of the downwardly-extending tube which is in the lower plenum.

Primary sodium coolant of a high temperature flows into the heat exchanger body from the portion thereof which is below an upper tube plate, and flows out of the heat exchanger body from the portion thereof which is above the lower tube plate. Secondary sodium coolant of a low temperature flows downward through the downwardly-extending tube to be ejected in the horizontal direction from the above-mentioned openings into the lower plenum to flow in parallel currents therein to enter each of the heat transfer tubes and advance upward. The secondary sodium coolant heated in the heat transfer tubes is ejected into the upper plenum.

13 Claims, 12 Drawing Figures

HEAT EXCHANGER

BACKGROUND OF THE INVENTION

This invention relates to a heat exhanger, and more particularly to a heat exchanger suitably used as an intermediate heat exchanger for fast breeders.

The heat exchange between primary and secondary cooling systems in a fast breeder is carried out by an intermediate heat exchanger. The intermediate heat exchanger consists of two shells, i.e. outer and inner cylinders, and a plurality of heat transfer tubes provided in the inner cylinder. The upper and lower end portions of each of the heat transfer tubes are joined to tube sheets provided in the inner cylinder. A lower plenum is provided in the portion of the interior of the inner cylinder which is under the lower tube plate. A downcommer tube inserted into the inner cylinder is joined at its lower end with the lower plenum.

The sodium coolant in the primary cooling system, which is heated in the fast breeder, is supplied into the inner cylinder via the outer cylinder to flow downward along outer surfaces of the heat transfer tubes. On the other hand, the sodium coolant in the secondary cooling system, which is cooled by a steam generator, flows into the lower plenum through the downcommer tube. The sodium entering the lower plenum turns reversely, i.e. flows upward and into the heat transfer tubes. While the sodium in the secondary cooling system flows upward in the heat transfer tubes, it is subjected to heat exchange between itself and the sodium in the primary cooling system. Since the sodium in the secondary cooling system turns reversely in the lower plenum, the flow rate of the sodium passing through the heat transfer tubes is poorly distributed. Namely, the flow rate of the sodium flowing through such heat transfer tubes that are in a peripheral portion of the interior of the inner cylinder becomes higher. When the distribution of flow rates of the sodium flowing into the heat transfer tubes is not uniform, the distribution of temperature and velocity of flow of heat therein becomes uneven. This causes the performance of the heat exchanger to drop.

In order to settle the above problems, a heat exchanger disclosed in Japanese Patent Laid-Open No. 42690/1981 was proposed, in which a current-setting plate having a plurality of bores is provided in a lower plenum to divide the interior thereof into upper and lower regions with a downwardly extending tube inserted into the region below the current-setting plate. In an intermediate heat exhanger having such a current-setting plate, the distribution of flow rate of sodium introduced from a secondary cooling system into heat transfer tubes becomes uniform. However, in a transitional period of time, in which, for example, a nuclear reactor is interrupted, thermal impacts are repeatedly applied to the material forming the lower plenum.

SUMMARY OF THE INVENTION

An object of the present invention is to provide a heat exchanger, which permits minimizing the thermal impacts, which are repeatedly applied to the lower plenum during a transitional period of time in an operation of a machine, in which the heat exchanger is used.

The characteristics of the present invention reside in that a fluid supply tube is provided with a means for ejecting a fluid in the radial direction thereof in a plenum.

DESCRIPTION OF THE PREFERRED EMBODIMENTS

Figure 1:
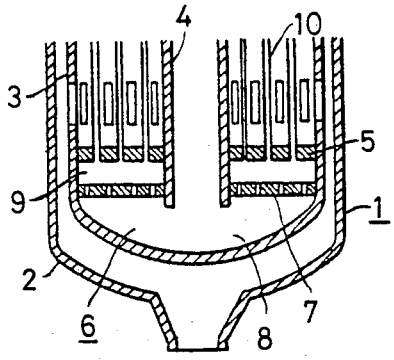
FIG. 1 (PRIOR ART)
FIG. 1 is a longitudinal sectional view of a lower portion of a conventional intermediate heat exchanger.

The present invention has been achieved on the basis of the results of a thorough discussion of the flowing condition of the sodium in a secondary cooling system in a lower plenum in an intermediate heat exchanger 1 disclosed in Japanese Utility Model Laid-Open No. 42690/1981. The results of the discussion are as follows. FIG. 1 shows the construction of a lower section of the intermediate heat exchanger disclosed in Japanese Utility Model Laid-Open No. 42690/1981. The sodium in a primary cooling system, which is introduced into an outer cylinder 2 flows downward in an inner cylinder 3. The sodium in a secondary cooling system, which flows downward in a downwardly-extending tube 4, enters a lower plenum 6 defined by the inner cylinder 3 and a lower tube plate 5, to be more precise, a region 8, which is in the lower plenum 6 and below a current-setting plate 7 having a plurality of bores. The sodium in the secondary cooling system then passes through the bores in the current-setting plate 7 to enter a region 9, which is in the plenum 6 and above the current-setting plate 7, the sodium being then distributed into heat transfer tubes 10 fixed to the lower tube plate 5.

Figure 2:
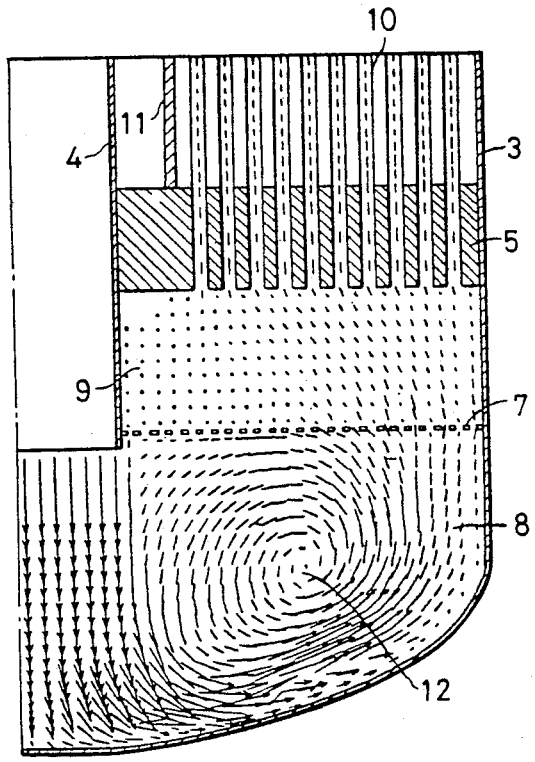
FIG. 2 illustrates the flowing condition of the sodium in a lower plenum in the heat exchanger shown in FIG. 1.

The flowing condition of the sodium in the lower plenum 6 in the lower section of the intermediate heat exchanger 1 is shown in FIG. 2. Reference numeral 11 denotes a heat shielding member, which is not shown in FIG. 1, and which is formed so as to surround the downwardly extending tube. Since the intermediate heat exchanger 1 is provided with the current-setting plate 7 in the lower plenum 6 therein, the sodium flows uniformly in the region 9 therein. Accordingly, the flow rates of the sodium supplied into the heat transfer tubes 10 become substantially equal. In fact, a ratio (deviation value) $\delta max$ of an average value Vo of the velocities Vi of flow of the sodium passing through the heat transfer tubes 10 to a maximum value Vmax of the velocities Vi of flow of the sodium is 1.15. Since all of the heat transfer tubes 10 have the same inner diameter, the $\delta max$ represents a deviation value of the flow rates of the sodium. As shown in FIG. 2, a vortex 12 of the sodium, which is discharged from the downcommer tube 4, occurs in the region 8 in the lower plenum 6. A vortex 12 of the sodium in the lower plenum 6 causes the turbine trip. When the turbine trip occurs, a flow rate of the feed water supplied to a steam generator suddenly decreases. The vortex 12 of sodium also causes a decrease in a flow rate of the feed water while an operation of the fast breeder is interrupted. As a result, a high-cycle thermal impact is applied to the material forming the lower plenum 6. The sodium cooled in the steam generator and having a low temperature (about 320° C.) exists in the lower plenum 6. For example, when the turbine trip occurs, the steam stops being supplied from the steam generator to the turbine, and, at the same time, a flow rate of the water supplied to the steam generator suddenly decreases. Consequently, the cooling of sodium with feed water in the steam generator cannot be sufficiently carried out. The high-temperature sodium (having a temperature of about 510° C.), which is discharged from the steam generator in a substantially non-cooled state, flows into the region 8 in the lower plenum 6 through the downcommer tube 4. The low-temperature sodium is held in the region 8 before the high-temperature sodium has flowed thereinto. The high-temperature sodium ejected downward from the downwardly-extending tube 4 flows upward in the region 8 along a bottom surface of the cylinder 3 as shown in FIG. 2. Consequently, a vortex 12 occurs in the region 8. Due to the entry of the high-temperature sodium into the region 8, the low-temperature sodium therein does not flow out therefrom at once through the current-setting plate 7 but flows vertically in the region 8. As the high-temperature sodium flows into the region 8, the low-temperature sodium is scraped at a superficial portion thereof intermittently by the vortex 12. The low-temperature sodium thus scraped passes through the lower tube plate 5 with the high-temperature sodium to enter the heat transfer tubes 10. Since the velocity of flow of the scraped low-temperature sodium is high, it passes through the lower tube plate 5 at a low temperature, i.e. without being heated sufficiently by the high-temperature sodium. The low-temperature sodium and high-temperature sodium contact alternately in extremely short cycles the lower tube plate 4 and the portion of the inner surface of the inner cylinder 3 which defines the lower plenum. Accordingly, when the turbine trip occurs, high-cycle thermal impacts are applied to the bottom portion of the inner cylinder 3 and lower tube plate 4. The same applies while an operation of the fast breeder is interrupted.

The inventors discussed various methods capable of reducing the high-cycle thermal impacts to minimize the thermal fatigue of the lower tube plate and a wall defining the lower plenum, and discovered that, when the sodium is ejected from the downwardly-extending tube in the radial direction, parallel currents thereof can be generated in the lower plenum with no vortex occuring therein. The present invention has been achieved on the basis of this discovery.

Figure 3:
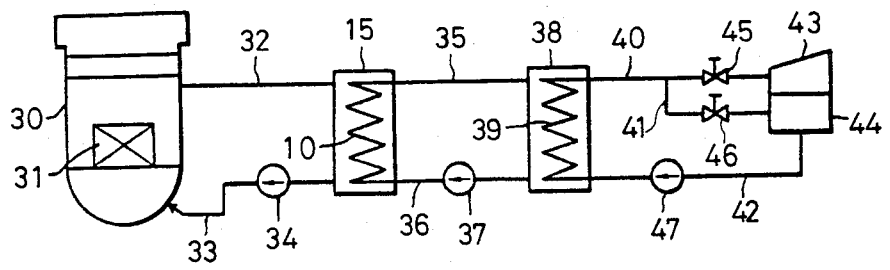
FIG. 3 is a system diagram of a fast breeder.

An intermediate heat exchanger, which constitutes a preferred embodiment of the present invention, and which is applied to a fast breeder, will be described with reference to FIGS. 3 and 4.

While a fast breeder is in a regular operation, the sodium heated in a core 31 in a reactor vessel 30 is introduced into an intermediate heat exchanger 15 through a pipe 32 in a primary cooling system by an operation of a pump 34, to be cooled with the sodium supplied into heat transfer tubes 10 in the intermediate heat exchanger 15 through a pipe 36 in a secondary cooling system. The sodium discharged from the intermediate heat exchanger 15 is returned to the reactor vessel 30 through a pipe 33 in the primary cooling system. The sodium is heated while it passes through the heat transfer tubes 10, to a temperature of about 320° C. to about 510° C. The sodium of a temperature of about 510° C. is sent to a steam generator 38 through a pipe 35 in the secondary cooling system. This sodium is cooled with the feed water supplied into heat transfer tubes 39 in the steam generator 38 through a feed water pipe 42, to be discharged into the pipe 36 in the second cooling system. Reference numeral 37 denotes a pump. The feed water flowing through the heat transfer tubes 39 in the steam generator 38 is heated with the sodium to turn into steam. The steam is sent to a turbine 43 through a main steam pipe 40. The steam discharged from the turbine 43 is made more dense in a condenser 44 to turn into water. This water is returned to the heat transfer tubes 39 by an operation of a feed water pump 47. During a regular operation of the fast breeder, a main steam valve 45 is opened, while a by-pass valve 46 is closed. Reference numeral 41 denotes a by-pass pipe.

Figure 7:
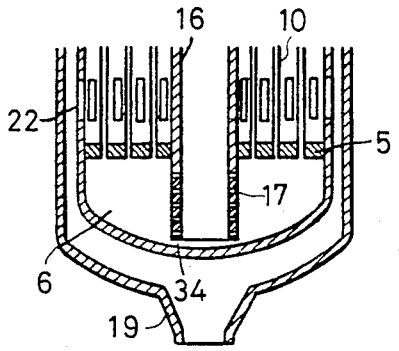
FIGS. 7 and 8 are longitudinal sectional views of lower portions of further embodiments of the present invention.

The intermediate heat exchanger 15 consists of an outer cylinder 2, an inner cylinder 3 provided in the outer cylinder 2, lower and upper tube plates 5, 23 provided in the inner cylinder 3, a plurality of heat transfer tubes 10 joined at their respective both end portions to the lower and upper tube plates 5, 23, and a downwardly-extending tube 16 provided in the central portion of the inner cylinder 3. The downwardly-extending tube 16 is connected to the pipe 36 in the secondary cooling system to extend through the upper and lower tube plates 23, 5 and reach the interior of a lower plenum 6. The upper and lower tube plates 23, 5 are welded to the inner cylinder 3 and downwardly-extending tube 16 so as to prevent the sodium in the secondary cooling system in an upper plenum 24 and lower plenum 6 from flowing out into such a space in the inner cylinder 3 that is on the side of the primary cooling system. The downwardly-extending tube 16 contacts at its lower end a bottom portion of the inner cylinder 3. However, it is not strictly necessary that the lower end of the downwardly-extending tube 16 and the bottom portion of the inner cylinder 3 be in contact with each other; a clearance 34 may be provided therebetween as shown in FIG. 7. A plurality of bores 17 are provided in the portion of a side wall of the downwardly-extending tube 16 whch is in the lower plenum 6 formed in such a portion of the interior of the inner cylinder 3 that is below the lower tube plate 5. The plural bores 17 are provided in the portion of the downwardly-extending tube 16 which is in the lower plenum 6 in such a manner that the bores 17 are arranged in the axial and circumferential directions of the tube 16. An inlet nozzle 18 provided in the outer cylinder 2 is connected to the primary cooling pipe 32, while an outlet nozzle 19 provided in the outer cylinder 2 is connected to the primary cooling pipe 33. An inlet 21 and an outlet 22 for sodium are provided at upper and lower portions of the inner cylinder 3. A partition member 20 is provided between the outer and inner cylinders 2, 3 in order to prevent the sodium from flowing in the outer cylinder 2 from the inlet nozzle 18 to the outlet nozzle 19 directly. Reference numeral 25 denotes support members for the heat transfer tubes 10.

The sodium in the primary cooling system, which flows from the inlet nozzle 18 into the outer cylinder 2, passes through the inlet 21 to enter the inner cylinder 3. The resulting sodium flows downward along the heat transfer tubes 10 to the outside of the cylinder 3 via the outlet 22, the sodium being then discharged from the outlet nozzle 19 into the primary cooling pipe 33. The sodium supplied from the secondary cooling pipe 36 flows downward in the downwardly-extending tube 16 to be ejected in the radial direction thereof from the plural bores 17. The clearance 34 (FIG. 7) and bores 17 constitute means for ejecting sodium in the radial direction of the downwardly-extending tube 16. The diameter of the bores 17 provided in the downwardly-extending tube 16 is the same with respect to the axial direction thereof. Accordingly, the flow rates of sodium ejected from such bores 17 that are provided in the portion of the downwardly-extending tube 16 which is closer to a lower end thereof become higher. The sodium ejected into the lower plenum 6 passes through the heat transfer tubes 10 to enter the upper plenum 24 provided above the upper tube plate 23, the sodium then flowing into the secondary cooling pipe 35.

Figure 5:
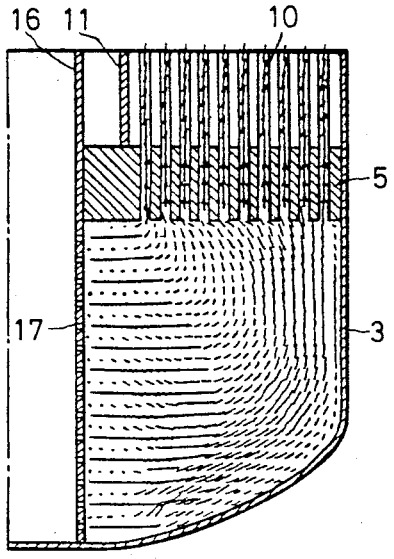
FIG. 5 illustrates the flowing condition of the sodium in a lower plenum in the embodiment shown in FIG. 4.

The flowing condition of the sodium in the lower plenum 6 in this embodiment is shown in FIG. 5. The sodium ejected from the bores 17 arranged in the downwardly-extending tube 16 in the axial direction thereof forms parallel currents as shown in FIG. 5, which flow horizontally (in the radial direction of the downwardly-extending tube 16) in the lower plenum 6 as they remain to be in parallel with one another, to thereafter turn into upward currents (flowing in the axial direction of the downwardly-extending tube 16). Therefore, no vortex of sodium occurs in the lower plenum 6. The lower plenum 6 has the functions of converting the downward currents of sodium in the downwardly-extending tube 16 into upward currents thereof. When the turbine trip occurs to cause an operation of a feed water pump 47 to be stopped, the feed water stops being supplied to the heat transfer tubes 39 in the steam generator 38. Consequently, the sodium in the secondary cooling system is not cooled in the steam generator 38. The sodium in the secondary cooling system is ejected as it remains to have a high temperature (about 510° C.), into the lower plenum 6 through the downwardly-extending tube 16 to flow in parallel currents. The low-temperature sodium (having a temperature of about 320° C.) held in the lower plenum 6 is pressed by the parallel currents of the high-temperature sodium toward the outside thereof. The degree of the thermal impact applied to the wall of the lower plenum 6 when the high-temperature sodium enters the plenum 6 is substantially equal to that of the thermal impact applied at such time as mentioned to the wall of the plenum in the conventional intermediate heat exchanger 1. In the intermediate heat exchanger 15, no vortex of low-temperature sodium occurs in the lower plenum 6. Accordingly, unlike the intermediate heat exchanger 1, which receives high-cycle thermal impacts every time the operation of the fast breeder is interrupted, the intermediate heat exchanger 15 does not receive any thermal impacts. This allows the thermal fatigue of the intermediate heat exchanger 15 to be reduced to a great extent.

Figure 6:
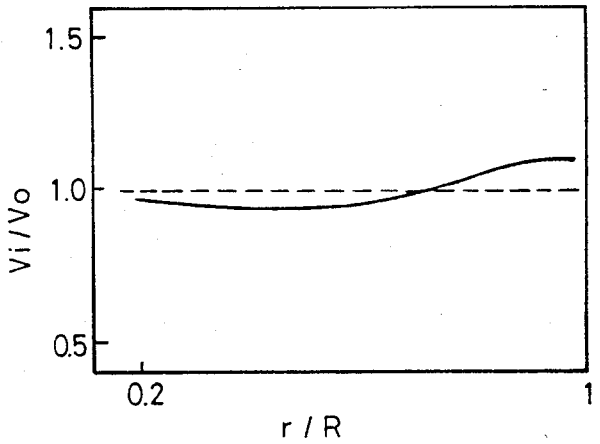
FIG. 6 is a characteristic diagram showing the distribution of sodium into heat transfer tubes in the intermediate heat exchanger shown in FIG. 4.

The distribution of flow rates of sodium in the heat transfer tubes 10 in the radial direction of the intermediate heat exchanger 15 is shown in FIG. 6. Reference letter R denotes the diameter of the inner cylinder 3, and r a distance between the axis of the inner cylinder 3 and the axes of the heat transfer tubes 10. In this embodiment, the $\delta max$ is 1.10, which indicates that the scatter of flow rates of the sodium flowing in the heat transfer tubes 10 in the intermediate heat exchanger 15 can be reduced to a greater extent than that in the intermediate heat exchanger 1.

This embodiment can be made by merely extending a part of the downwardly-extending tube into the lower plenum 6; it has a very simple construction.

Since the downwardly-extending tube 16 is set in such a manner that the tube 16 is in contact at its lower end with the bottom surface of the lower plenum 6, the vibration of the tube 16 can be prevented while the sodium is ejected from the bores 17 provided therein.

Figure 4:
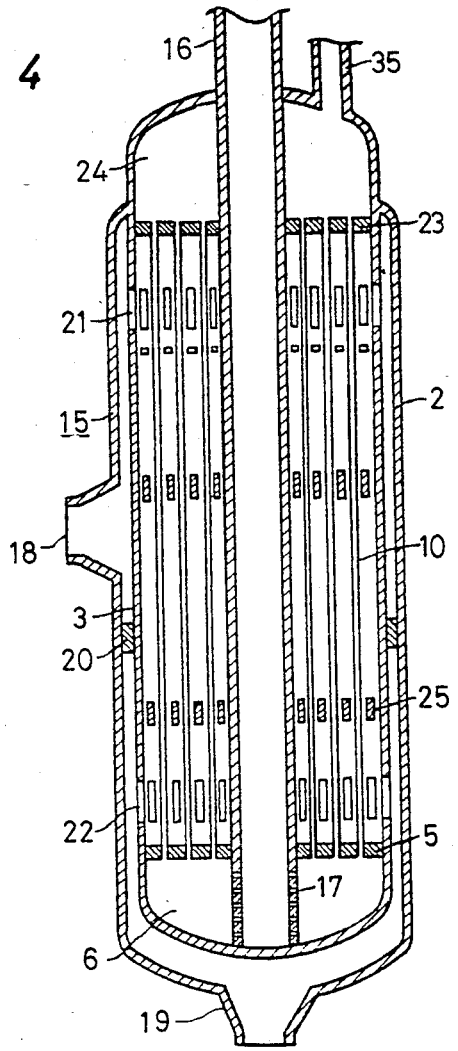
FIG. 4 is a longitudinal sectional view of a preferred embodiment of the present invention shown in FIG. 3.

When the clearance 34 is provided as in an embodiment shown in FIG. 7, it is preferable that a distance between the free end of the downwardly-extending tube 16 and the inner surface of the lower plenum 6 be set to not more than 10% of the height of the portion of the downwardly-extending tube 16 which is between the lower surface of the lower tube plate 5 shown in FIG. 4 and the bottom surface of the lower plenum 6 shown in the same figure. When the mentioned distance is not less than 10% of the height of the portion referred to above of the tube 16, there is the possibility that a vortex of sodium occurs in the lower plenum 6.

Figure 8:
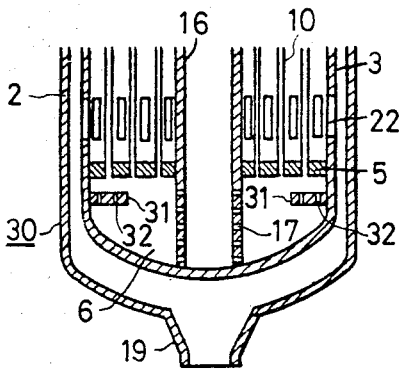
Figure 9:
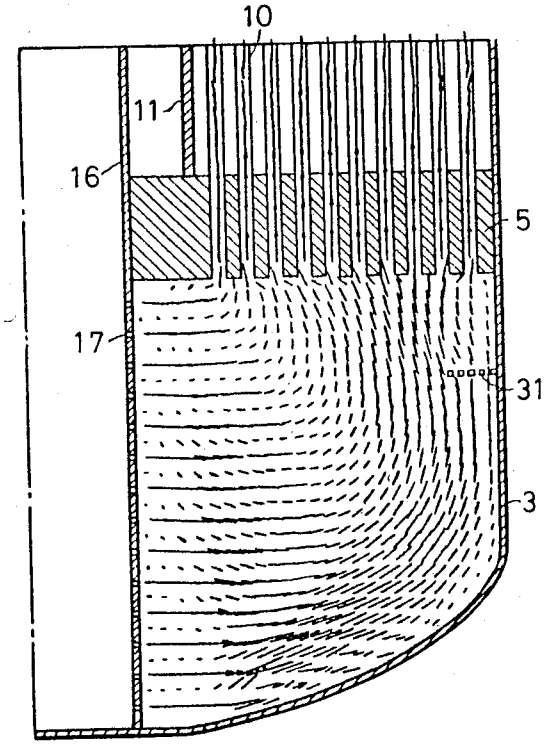

FIG. 8 shows another embodiment of an intermediate heat exchanger according to the present invention. This intermediate heat exchanger 30 is formed by providing a ring 31 having a plurality of bores 32 in the lower plenum 6 in the above intermediate heat exchanger 15. The ring 31 is fixed to the inner surface of an inner cylinder 3. The construction of the other portion of the heat exchanger 30 is identical with that of the intermediate heat exchanger 15. This embodiment permits obtaining the same effect as the intermediate heat exchanger 15. In this embodiment, the scatter of flow rates of sodium in the heat transfer tubes can be reduced to a greater extent ($\delta max = 1.095$) than that in the intermediate heat exchanger 15 owing to the influence of the ring 31. The flowing condition of the sodium in the lower plenum 6 in this embodiment is shown in FIG. 9. It is understood from the drawing that the flow of sodium to the heat transfer tubes 10 in a peripheral section of the interior of the inner cylinder 3 is restricted by the ring 31.

Figure 10:
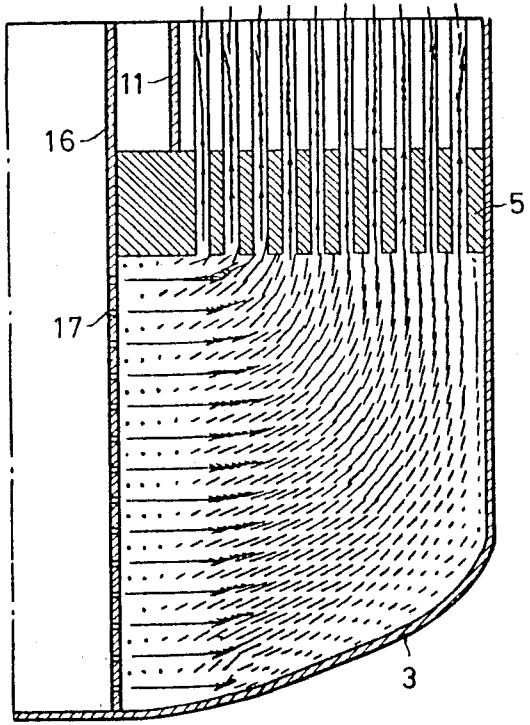
FIGS. 9, 10 and 11 illustrate the flowing condition of the sodium in lower plenums in further embodiments of the present invention.

Still another embodiment of the present invention is shown in FIG. 10. In this embodiment, the diameters of bores 17 gradually increase toward an upper portion of a lower plenum. Therefore, the flow rates of the sodium flowing out from these bores 17 become equal. This embodiment also permits obtaining the same effect as the intermediate heat exchanger 15. The $\delta max$ in this embodiment is 1.16.

Figure 11:
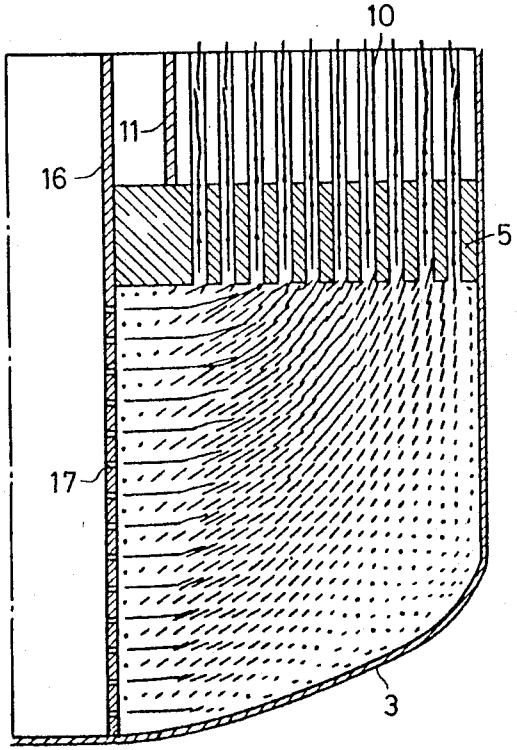

FIG. 11 shows the flowing condition of the sodium in a lower plenum in a further embodiment of the present invention. In this embodiment, the diameters of upper bores 17 are greater than those in the embodiment shown in FIG. 9, so that the flow rates of the sodium ejected from the bores 17 gradually increased toward an upper portion of a lower plenum. This embodiment also permits obtaining the same effect as the intermediate heat exchanger 16. The $\delta max$ in this embodiment is 1.18.

The diameters of the bores 17 to be provided in the downwardly-extending tube 16 may be set in such a manner that the bores 17 formed between a lower end of the tube 16 and a predetermined position thereon, which has a certain height above the lower end of the tube 16, have the same diameter with the remaining bores 17, which is formed above the mentioned position, having such diameters that increase gradually in the upward direction. In the region, in which the bores 17 having the same diameters are provided, the flow rates of the sodium ejected therefrom increases gradually in the downward direction. In an upper portion of the lower plenum, in which the bores 17 have gradually varying diameters, the sodium ejected therefrom flows at a uniform rate. This embodiment also permits obtaining the same effect as the intermediate heat exchanger 15. The δmax in this embodiment is 1.12.

Figure 12:
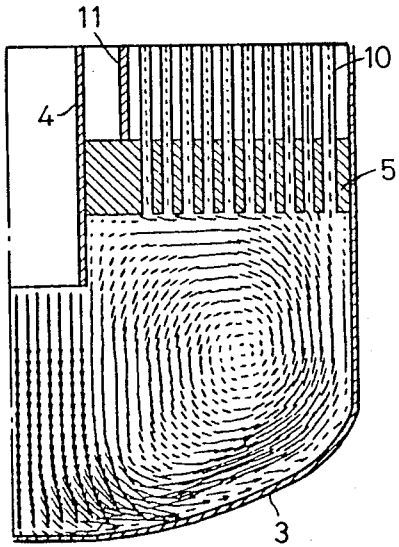
FIG. 12 illustrates the flowing condition of the sodium in a lower plenum in another conventional intermediate heat exchanger.

FIG. 12 shows another example of a conventional heat exchanger for reference. This heat exchanger is formed by removing the current-setting plate from the conventional heat exchanger shown in FIG. 1. The intermediate heat exchanger shown in FIG. 12 has a δmax of 1.39. Moreover, a vortex occurs in a lower plenum in this heat exchanger. Accordingly, the distribution of the flow rates of sodium in this example become uneven, so that high-cycle thermal impacts are also applied to the wall of a lower plenum. The embodiments described above of the present invention are far superior to this example.

According to the present invention, the constructional members permit minimizing the high-cycle thermal impacts applied thereto, so that the thermal fatigue thereof can be reduced to a great extent.

What is claimed is:

1. A heat exchanger, comprising:

a pair of tube plates;

a plurality of heat transfer tubes, each of which is joined at both of its end portions to said tube plates;

a first-fluid supply tube provided among said heat transfer tubes and joined to said tube plates;

a plenum so formed as to introduce therethrough a first fluid, which flows out from said first-fluid supply tube, into said heat transfer tubes;

a passage for introducing a second fluid into spaces around said heat transfer tubes and between said tube plates to be subjected to indirect heat exchange between itself and said first fluid;

said first-fluid supply tube being provided at a portion thereof which is within said plenum with means for supplying said first fluid from said supply tube in the radial direction of said first-fluid supply tube into said plenum;

said heat transfer tubes and said first-fluid supply to be being generally linear and parallel to each other;

said portion of the first-fluid supply tube within said plenum extending for substantially the entire height of said plenum with the lowermost end of said first-fluid supply tube adjacent to the bottom of said plenum within a range of less than 10% of the height of the portion of the first-fluid supply tube that is within said plenum, and said first-fluid supplying means disposed and extending downwardly in said plenum with one end being fluid connected to said first-fluid supply tube and the opposite end being at least adjacent to an inner surface of said plenum, and having a large number of openings peripherally and axially spaced apart over substantially the entire length of said supplying means within said plenum for directing the first-fluid radially and evenly into said plenum.

2. A heat exchanger according to claim 1, wherein said plenum is provided therein with a means for restricting a flow of said first fluid in a peripheral portion of the interior of said plenum.

3. A heat exchanger according to claim 2, wherein said flow-restricting means consists of a ring provided in a peripheral portion of the interior of said plenum, said ring having a plurality of bores.

4. The heat exchanger according to claim 1, including a container having therein said tube plates, heat transfer tubes and first-fluid supply tube; and wherein said plenum is formed by the lower one of said tube plates, and the lower end of said container.

5. The heat exchanger according to claim 1, further including means for supplying sodium as the first-fluid through said supply tube.

6. The heat exchanger according to claim 1, wherein said first-fluid supply tube lowermost end contacts said plenum.

7. The heat exchanger apparatus of claim 6, further including an annular ring radially spaced from said first-fluid supply tube within said plenum and adjacent the outer wall of said plenum below the lowermost one of said tube plates to provide means for restricting upward flow of the first fluid around the outer periphery of said plenum.

8. The heat exchanger apparatus of claim 6, wherein the diameter of said openings varies along the axial length of said first-fluid supply tube to help equalize the flow rates of the first-fluid into the lower ends of the heat transfer tubes.

9. A heat exchanger according to claim 6, wherein the diameter of said openings generally increases toward said one end.

10. The heat exchanger according to claim 1, wherein a plurality of baffles extend radially from said first-fluid supply tube within said plenum as a part of said means for supplying and with said openings therebetween.

11. The heat exchanger apparatus of claim 1, further including an annular ring radially spaced from said first-fluid supply tube within said plenum and adjacent the outer wall of said plenum below the lowermost one of said tube plates to provide means for restricting upward flow of the first fluid around the outer periphery of said plenum.

12. The heat exchanger apparatus of claim 1, wherein the diameter of said openings varies along the axial length of said first-fluid supply tube to help equalize the flow rates of the first-fluid into the lower ends of the heat transfer tubes.

13. A heat exchanger according to claim 1, wherein the diameter of said openings generally increases toward said one end.

* * * * *